US011008904B2

(12) United States Patent
Li

(10) Patent No.: US 11,008,904 B2
(45) Date of Patent: May 18, 2021

(54) CAMSHAFT PHASER COVER ELEMENT AND CAMSHAFT PHASER

(71) Applicant: Schaeffler Technologies AG & Co. KG, Herzogenaurach (DE)

(72) Inventor: Xin Li, Suzhou (CN)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/767,150

(22) PCT Filed: Nov. 28, 2017

(86) PCT No.: PCT/CN2017/113423
§ 371 (c)(1),
(2) Date: May 27, 2020

(87) PCT Pub. No.: WO2019/104491
PCT Pub. Date: Jun. 6, 2019

(65) Prior Publication Data

US 2020/0386124 A1 Dec. 10, 2020

(51) Int. Cl.
*F01L 1/34* (2006.01)
*F01L 1/344* (2006.01)

(52) U.S. Cl.
CPC ... *F01L 1/3442* (2013.01); *F01L 2001/34479* (2013.01); *F01L 2303/00* (2020.05)

(58) Field of Classification Search
CPC ..... F01L 1/3442; F01L 1/047; F01L 2303/00; F01L 2001/34479; F01L 2001/34483
See application file for complete search history.

(56) References Cited

U.S. PATENT DOCUMENTS 9,021,999 B2 * 5/2015 Yoshimura ..... F01L 1/34 123/90.17
2016/0222835 A1 8/2016 Narita et al.

FOREIGN PATENT DOCUMENTS

CN 202081520 U 12/2011
CN 105484894 A 4/2016
DE 102015205242 A1 9/2016

* cited by examiner

*Primary Examiner* — Zelalem Eshete
(74) *Attorney, Agent, or Firm* — Matthew V. Evans

(57) ABSTRACT

The present disclosure relates to a cover element for a camshaft phaser and a camshaft phaser. The cover element includes a journal and a cover plate, the journal is used to form sealing engagement with an oil seal, and the journal and the cover plate are connected by welding. A positioning portion is formed on the surface of the cover plate for positioning the journal. The cover element is formed by welding the cover plate and the journal, which are processed separately, so as to conveniently perform different processing of the cover plate and the journal. A positioning portion for positioning the journal is formed on the surface of the cover plate so as to easily position the journal during the welding process, which enables the journal and the cover plate to be easily welded together without requiring complicated fastening. This improves processing efficiency and reduces production costs.

18 Claims, 7 Drawing Sheets

CAMSHAFT PHASER COVER ELEMENT AND CAMSHAFT PHASER

CROSS REFERENCE TO RELATED APPLICATIONS

This application is the U.S. National Phase of PCT Application No. PCT/CN2017/113423 filed on Nov. 28, 2017 the disclosure of which is incorporated by reference herein.

TECHNICAL FIELD

The present disclosure relates to a camshaft phaser, and more particularly, to a camshaft phaser having a cover element.

BACKGROUND

In the camshaft phaser, a front cover and a back cover are used for sealing, and a journal portion, which protrudes from a front cover plate of the front cover and a back cover plate of the back cover, may engage with a floating oil seal to achieve a radial seal, thereby preventing oil leakage.

US Patent Publication US2016222835A1 is known. In this patent publication, as shown in FIGS. 1A and 1B (FIGS. 9A and 9B of the patent publication), a front cover 100 includes a plate member 101 and a cylindrical member 102; the cylindrical member 102 is set in the hole edge 103 of the plate member 101, and the plate member 101 and the cylindrical member 102 are welded together by use of friction welding, so that the friction welding will form a crimped portion 104.

This solution is used for chain drive phasers and does not require a complete oil seal. The disadvantages of this solution include difficulty in effectively positioning the plate member 101 and the cylindrical member 102 when welding. Meanwhile, friction welding is carried out by means of extrusion and friction, which can easily cause deformation of parts, and friction welding has high equipment requirements and poor design flexibility. The above disadvantages limit the application of this solution to dry belt journals with high precision requirements.

German Patent Publication DE102015205242A1 is also known. In this patent publication, as shown in FIG. 2 (FIG. 1 of the patent publication), a first cover 202 is generally cup-shaped and surrounds a stator 201, and the first cover 202 is welded to the stator 201, so that the first cover 202 and the stator 201 cannot rotate relative to each other. A second cover 205 is disposed opposite to the first cover 202 and welded to the first cover 202. A driving wheel 204 is welded to the first cover 202, and a flange 203 on the side of the driving wheel 204 is welded to the first cover 202.

This solution is for the application of the central bolt dry belt, and the oil seal is achieved by welding the thin plates. The disadvantages of this solution include complex thin plate configuration of the first cover 202 and the second cover 205, poor molding accuracy, low rigidity, and easy deformation of welding; moreover, the clamping, processing deformation, etc. during the machining process lead to the limited application of this solution in the dry belt phaser of the central control valve.

As shown in FIG. 3, the existing camshaft phaser includes a stator 302 and a rotor 305; a front cover 301 and a back cover 304 are fixed on both axial sides of the stator 302 by a bolt 303, and sealing rings 306 are provided both between the stator 302 and the front cover 301 and the back cover 304. The front cover 301 includes a plate portion 307 and a journal portion 308, which protrudes from the plate portion 307, for forming a seal with a floating oil seal. In order to ensure the wear resistance of the journal portion 308 and the floating oil seal, the journal portion 308 needs to be heat treated to increase the hardness.

The disadvantages of this solution include a local heat treatment process of the journal portion 308, which is not easy to realize, and high cost of the overall heat treatment of the front cover 301. The front cover 301 is formed by machining, so the material utilization is low, and it is difficult to process the journal portion due to its large aspect ratio (axial length/diameter), resulting in low processing efficiency and high cost.

SUMMARY

The present disclosure is proposed in order to solve processing and heat treatment problems of a cover element of a camshaft phaser.

The present disclosure provides a cover element for a camshaft phaser. The cover element includes a journal and a cover plate; the journal is used to form sealing engagement with a floating oil seal, and the journal and the cover plate are connected by welding, wherein a positioning portion for positioning the journal is formed on the surface of the cover plate.

In at least one implementation, the cover element is a front cover of the camshaft phaser.

In at least one implementation, the positioning portion is a step formed on the surface of the cover plate, and the axial thickness of the cover plate at the step is greater than the axial thickness of other portions of the cover plate.

In at least one implementation, the step is located radially inside and/or radially outside of the journal.

In at least one implementation, the step is annular-shaped, the outer diameter of the step is substantially the same as the inner diameter of the journal, or the inner diameter of the step is substantially the same as the outer diameter of the journal.

In at least one implementation, the journal and the cover plate are welded and connected by one of laser welding, resistance welding, arc welding and brazing.

In at least one implementation, the journal is heat-treated before being welded to the cover plate.

In at least one implementation, the cover plate is manufactured from a metal plate by stamping, cutting and/or machining.

In at least one implementation, the journal is made of a seamless tube profile, and/or, the journal is made by one or more processes of extrusion, spinning, rolling, and machining.

The present disclosure further provides a camshaft phaser including a stator, a rotor, a front cover, and a back cover; the back cover, the stator and the front cover are fixedly connected by a bolt, and the rotor is located radially inside of the stator, wherein, the front cover and/or the back cover are cover elements according to the present disclosure.

It should be understood that "cover element" in this application may refer to "front cover" and "back cover", and "cover plate" may refer to "front cover plate" and "back cover plate."

In the present disclosure, the cover element is formed by welding the cover plate and the journal, which are processed separately, so as to conveniently perform different processing of the cover plate and the journal. A positioning portion for positioning the journal is formed on the surface of the cover plate so as to easily position the journal during the welding process, which enables the journal and the cover plate to be easily welded together without requiring complicated fastening. This improves processing efficiency, simplifies the processing and reduces production costs.

LIST OF REFERENCE CHARACTERS

Figure 1A:
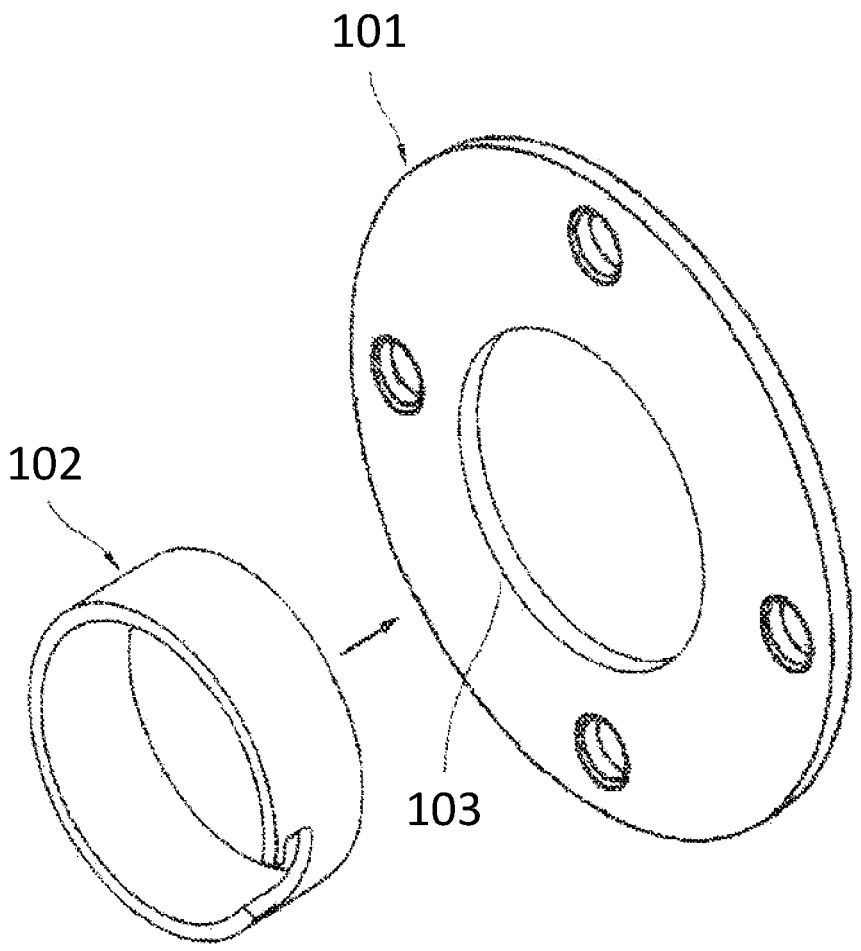
FIG. 1A (PRIOR ART)
FIGS. 1A and 1B illustrate a structure of a front cover of a current art camshaft phaser.
Figure 1B:
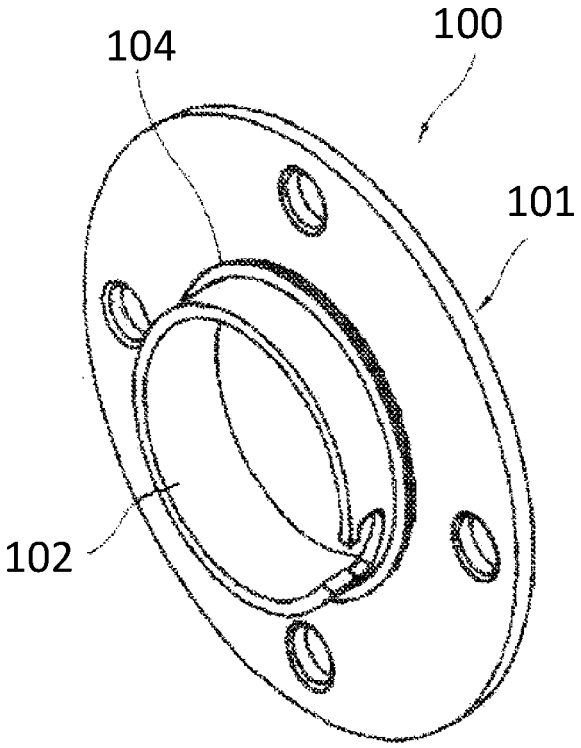
FIG. 1B (PRIOR ART)
Figure 2:
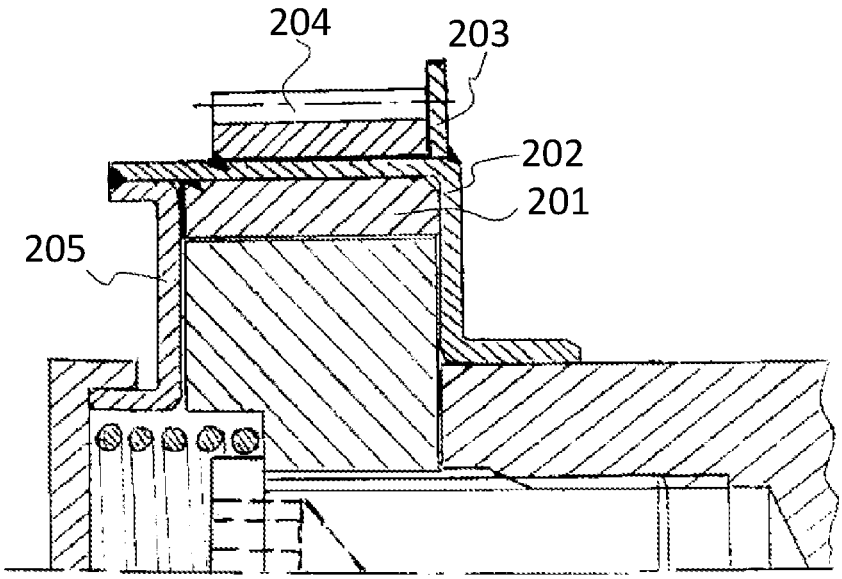
FIG. 2 (PRIOR ART)
FIG. 2 illustrates a structure of another current art camshaft phaser.
Figure 3:
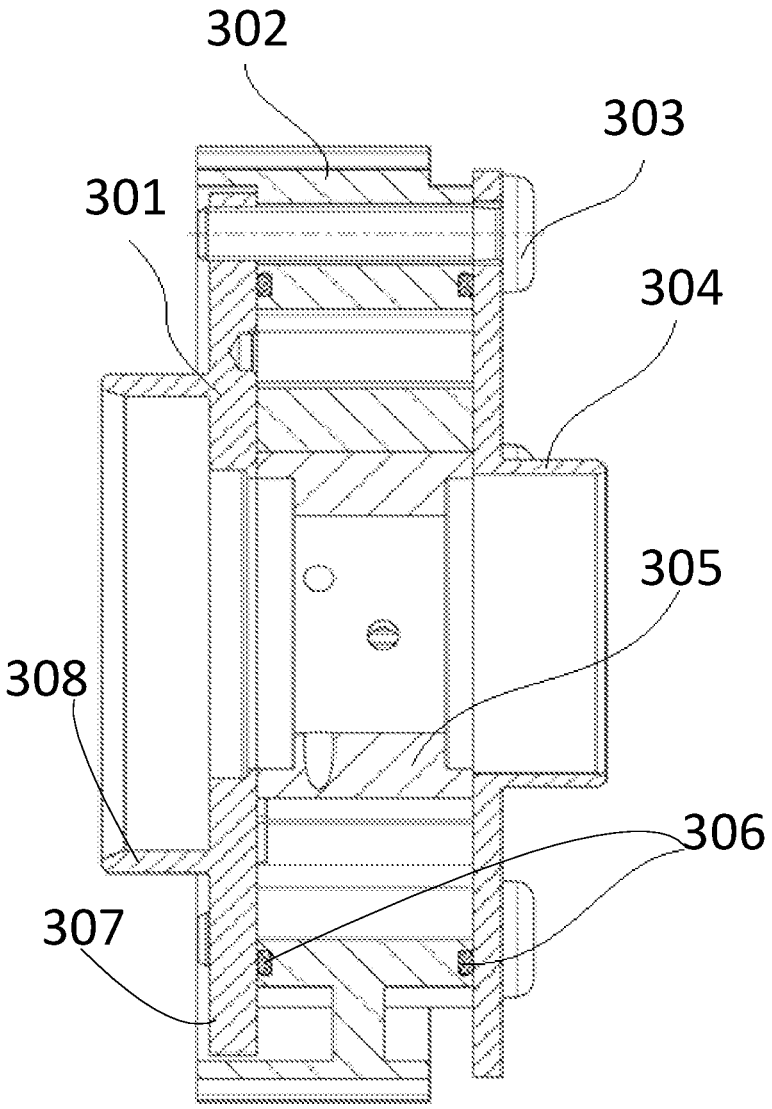
FIG. 3 (PRIOR ART)
FIG. 3 illustrates an axial cross-sectional view of still another current art camshaft phaser.

1 front cover journal
1A front cover journal
1B front cover journal
2 front cover plate
2A front cover plate
2B front cover plate
3 seal rings
4 rotor
5 back cover
6 bolt
7 stator
8 front cover
8A front cover
8B front cover
21 central hole
22 step
22A step
22B step
23 threaded holes
24B groove
25 oil seal
51 back cover journal
52 back cover plate
100 front cover
101 plate member
102 cylindrical member
103 hole edge
104 crimped portion
201 stator
202 first cover
203 flange
204 drive wheel
205 second cover
301 front cover
302 stator
303 bolt
304 back cover
305 rotor
306 sealing rings
307 plate portion
308 journal portion

DETAILED DESCRIPTION

Exemplary implementations of the present disclosure will be described below with reference to the drawings. It should be understood that these specific descriptions are only used to teach those skilled in the art how to implement the present disclosure and are not intended to be exhaustive of all possible variations of the present disclosure, nor to limit the scope of the present disclosure.

Figure 4:
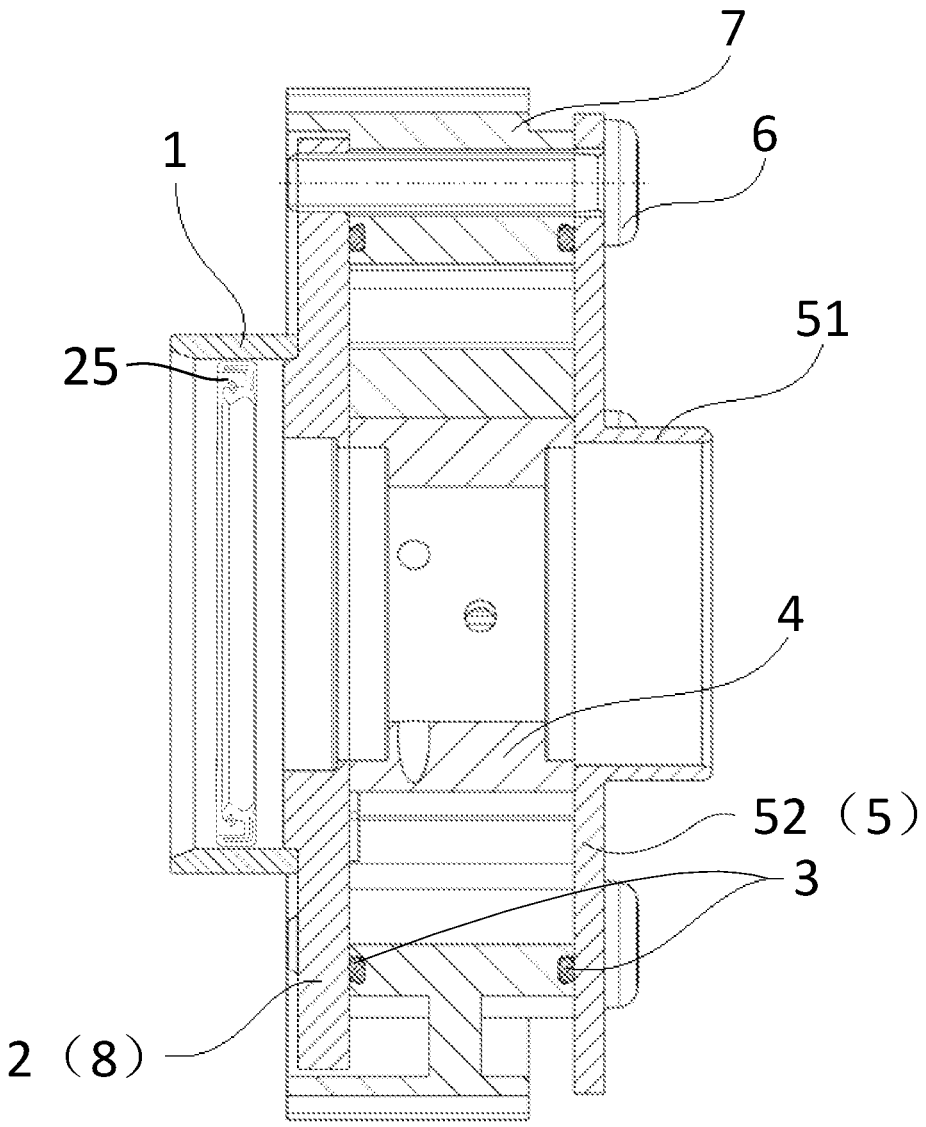
FIG. 4 illustrates an axial cross-sectional view of a camshaft phaser according to one implementation of the present disclosure.
Figure 5:
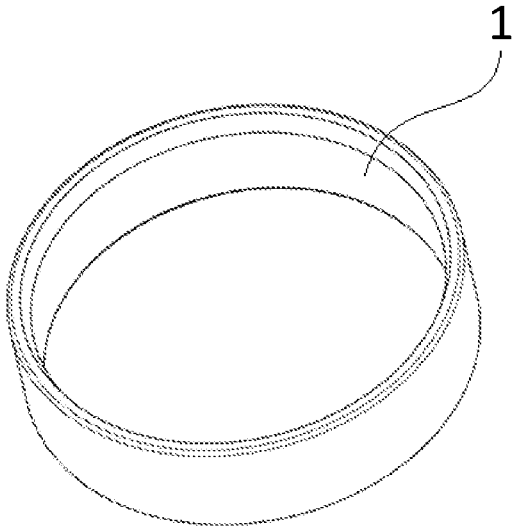
FIG. 5 illustrates a schematic view of a front cover journal of the camshaft phaser in FIG. 4.
Figure 6:
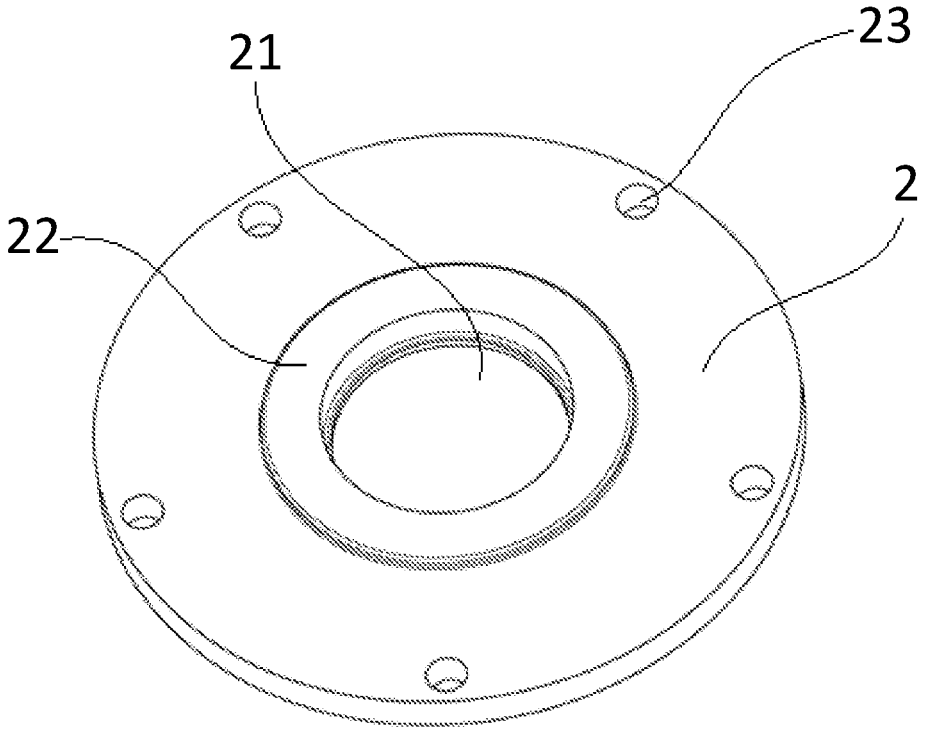
FIG. 6 illustrates a schematic view of a front cover plate of the camshaft phaser in FIG. 4.
Figure 7:
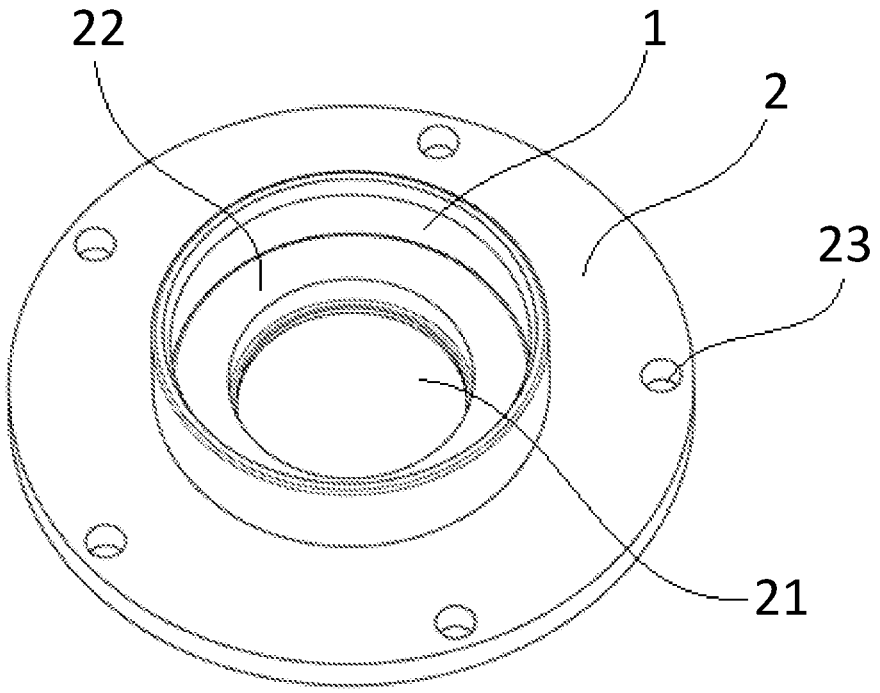
FIG. 7 illustrates a schematic view of a front cover consisting of the front cover journal in FIG. 5 and the front cover plate in FIG. 6.

The overall structure of the camshaft phaser of the present disclosure will be described first with reference to FIG. 4.

The camshaft phaser of the present disclosure includes a stator 7, a rotor 4, a front cover 8 and a back cover 5. A bolt 6 is passed through the back cover 5, the stator 7 and the front cover 8 in sequence to fixedly connect these three. The rotor 4 is located radially inside of the stator 7. The back cover 5 includes a back cover journal 51 and a back cover plate 52 that are integrally formed. The back cover plate 52 is annular plate-shaped, the back cover journal 51 is cylindrical-shaped, and the back cover journal 51 protrudes from the surface of the back cover plate 52.

In order to achieve a seal between the stator 7 and the front cover 8 and the back cover 5, seal rings 3 are provided between the stator 7 and the front cover 8 and between the stator 7 and the back cover 5. The stator 7 may be formed with corresponding grooves for accommodating the seal rings 3.

The structure of the front cover 8 of the camshaft phaser of the present disclosure will be further described below with reference to FIGS. 4 to 8.

The front cover 8 includes a front cover plate 2 and a front cover journal 1. The front cover journal 1 is cylindrically-shaped, and the front cover plate 2 is annular plate-shaped and includes a central hole 21. The front cover journal 1 is coaxial with the front cover plate 2, and the front cover journal 1 and the front cover plate 2 may be connected by means of welding. The welding process includes, but is not limited to, laser welding, resistance welding, arc welding and brazing. Threaded holes 23 for fixing the bolt 6 are evenly distributed in the circumferential direction of the front cover plate 2.

The diameter of the central hole 21 is smaller than the inner diameter of the front cover journal 1, so that a portion around the central hole 21 of the front cover plate 2 is within the radially inside region of the front cover journal 1. The portion of the front cover plate 2 located radially inside of the front cover journal 1 may function as a seal and may prevent an axial oil leakage.

A step 22 is formed on a side surface of the front cover plate 2, that is, the surface facing the front cover journal 1, so that the axial thickness of the front cover plate 2 at the step 22 is greater than the axial thickness of other portions. In other words, the front cover plate 2 includes a thick portion located radially inside the front cover journal 1 and a thin portion located radially outside of the front cover journal 1. The step 22 is formed into an annular shape, and the outer diameter of the step 22 is substantially the same as the inner diameter of the front cover journal 1, so that the front cover journal 1 can be positioned at the outer periphery of the step 22, thus the front cover journal 1 and the front cover plate 2 can be effectively positioned. The other side surface of the front cover plate 2, that is, the surface facing the stator 7 may be formed as a flat surface. In the case where the step 22 is located radially inside of the front cover journal 1, the material amount of the front cover plate 2 may be minimized while ensuring the strength.

Figure 8:
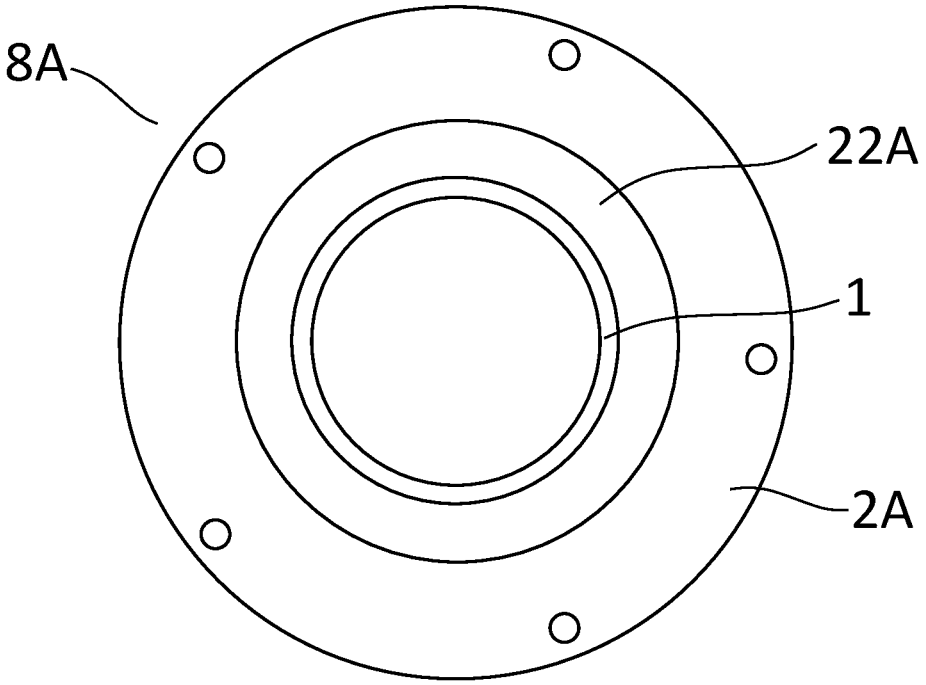
FIG. 8 illustrates a front view of an embodiment of a front cover with a step arranged radially outward of a front cover journal.

The step may be located not only radially inside of the front cover journal 1, but also radially outside of the front cover journal 1 as shown in FIG. 8. In FIG. 8's embodiment of a front cover 8A, a step 22A is located radially outside of the front cover journal 1, and the inner diameter of the step is substantially the same as the outer diameter of the front cover journal 1, thereby facilitating positioning of the front cover journal 1 relative to the front cover plate 2A.

The front cover plate 2, 2A may be made of a metal plate. The front cover plate 2, 2A may be manufactured by various processes such as stamping (especially fine stamping), cutting and/or machining.

The front cover journal 1 can be made using existing seamless tube profile.

However, the present disclosure is not limited thereto; the front cover journal 1 may also be made using one or more processes of such as, but not limited to, extrusion, spinning, rolling, machining, and the like.

In order to ensure the wear resistance of the front cover journal 1 and the floating oil seal 25, the front cover journal 1 may be heat-treated before the front cover journal 1 is welded to the front cover plate 2, 2A.

While the specific technical solutions of the present disclosure have been described in detail in Detailed Description, it should be noted that:

(1) In the above implementations, the bolt 6 is passed through the back cover 5, the stator 7 and the front cover 8, 8A in sequence to fixedly connect these three, and the threaded holes 23 are formed on the front cover 8, 8A to cooperate with the bolt 6 to connect. However, the present disclosure is not limited thereto; the threaded holes 23 on the front cover 8, 8A may also be through holes; in this case, a nut may be used to engage with the bolt 6 to connect the back cover 5, the stator 7, and the front cover 8, 8A.

Figure 9:
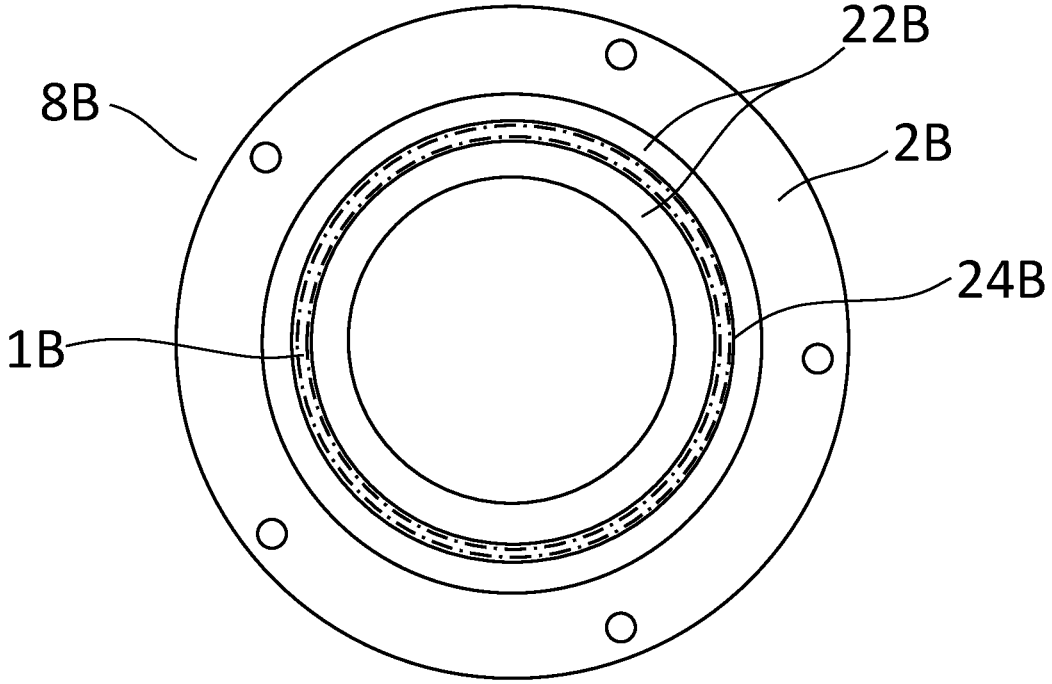
FIG. 9 illustrates a front view of an embodiment of a front cover configured with a groove to receive a front cover journal.

(2) In the above implementations, the step 22, 22A formed on the surface of the front cover plate 2, 2A is located radially inside or radially outside of the front cover journal 1. However, the present disclosure is not limited thereto; as shown in FIG. 9, the step 22B may be located both radially inside and radially outside of the front cover journal 1B to form a groove 24B between two steps, for accommodating the front cover journal 1B, and the front cover journal 1B is positioned within the groove 24B, so that the front cover journal 1B and the front cover plate 2B may still be effectively positioned. For example, the groove may be formed by stamping the front cover plate 2B having a uniform thickness. For clarity purposes of FIG. 9's arrangement (particularly, the groove 24B), the front cover journal 1B is drawn with broken lines.

(3) In the above implementations, the back cover 5 includes a back cover journal 51 and a back cover plate 52 that are integrally formed. However, the present disclosure is not limited thereto; it is also possible that the back cover 5 employs a structure similar to that of the front cover 8, that is, the split back cover journal 51 and the back cover plate 52 are connected by welding, and the surface of the back cover plate 52 may be provided with a step so that the back cover journal 51 is positioned by the step.

The benefits of the above implementations of the present disclosure will be described below.

(1) The front cover journal 1, 1B and the front cover plate 2, 2A, 2B are connected by welding, which reduces the workload of machining, improves material utilization and processing efficiency, and reduced costs. The above advantages will be more apparent, especially when the ratio of the axial length to the diameter of the front cover journal 1 engaged with the floating oil seal 25 is large.

(2) The front cover journal 1, 1B may be heat treated separately, which may simplify the heat treatment process and reduce costs.

(3) A step 22, 22A, 22B is formed on the surface of the front cover plate 2, 2A, 2B, causing the step 22, 22A, 22B to radially restrict the front cover journal 1, 1B, so that the front cover journal 1, 1B and the front cover plate 2, 2A, 2B can be effectively positioned. Furthermore, the front cover plate 2, 2A, 2B is thickened by the step 22, 22A, 22B, so that the rigidity of the front cover plate 2, 2A, 2B may be increased. When the front cover journal 1, 1B is connected to the front cover plate 2, 2A, 2B by welding, the deformation of the front cover journal 1, 1B and the front cover plate 2, 2A, 2B in welding may be reduced, which is suitable for the high precision requirements of the engagement seal of the front cover journal 1, 1B and the floating oil seal 25.

Of course, the present disclosure is not limited to the above implementations, and those skilled in the art can make various changes and modifications to the above implementations of the present disclosure without departing from the scope of the present disclosure under the teaching of the present disclosure.

The invention claimed is:

1. A cover for a camshaft phaser, wherein the cover includes a journal and a cover plate, the journal configured to form sealing engagement with an oil seal, and the journal and the cover plate configured to be connected by welding, wherein a positioning portion for positioning the journal is formed on a surface of the cover plate.

2. The cover for a camshaft phaser according to claim 1, wherein the cover is a front cover of the camshaft phaser.

3. The cover for a camshaft phaser according to claim 1, wherein the positioning portion is a step formed on the surface of the cover plate, and an axial thickness of the cover plate at the step is greater than an axial thickness of other portions of the cover plate.

4. The cover for a camshaft phaser according to claim 3, wherein the step is located radially inside of the journal.

5. The cover for a camshaft phaser according to claim 3, wherein the step is annular-shaped, an outer diameter of the step is substantially the same as an inner diameter of the journal.

6. The cover for a camshaft phaser according to claim 1, wherein the journal and the cover plate are welded and connected by one of laser welding, resistance welding, arc welding or brazing.

7. The cover for a camshaft phaser according to claim 1, wherein the journal is heat-treated before attachment to the cover plate.

8. The cover for a camshaft phaser according to claim 1, wherein the cover plate is manufactured from a metal plate by stamping, cutting, or machining.

9. The cover for a camshaft phaser according to claim 1, wherein the journal is made from a seamless tube.

10. The cover for a camshaft phaser according to claim 3, wherein the step is located radially outside of the journal.

11. The cover for a camshaft phaser according to claim 3, wherein the step is located radially inside and radially outside of the journal.

12. The cover for a camshaft phaser according to claim 11, wherein the step is configured with a groove to receive the journal.

13. The cover for a camshaft phaser according to claim 3, wherein the step is annular-shaped, and an inner diameter of the step is substantially the same as an outer diameter of the journal.

14. The cover for a camshaft phaser according to claim 1, wherein the cover is configured to engage an axial seal of a stator of the camshaft phaser.

15. The cover for a camshaft phaser according to claim 1, wherein the cover plate and positioning portion are configured to position the journal relative to the cover plate both axially and radially.

16. The cover for a camshaft phaser according to claim 1, wherein the positioning portion is configured to position the journal relative to the cover plate both axially and radially.

17. A camshaft phaser comprising:

a stator, a rotor arranged radially inward of the stator, a front cover, and a back cover; the back cover, the stator and the front cover are fixedly connected by a bolt, and, at least one of the front cover or the back cover include:

a first journal, and a cover plate, the journal configured to form sealing engagement with an oil seal, and the journal and the cover plate are configured to be connected by welding, wherein a positioning portion for positioning the journal is formed on a surface of the cover plate.

18. The cover for a camshaft phaser according to claim 17, wherein a remaining one of the front cover or the back cover includes second journal.

* * * * *